US008419604B2

(12) United States Patent
Haller

(10) Patent No.: US 8,419,604 B2
(45) Date of Patent: Apr. 16, 2013

(54) APPARATUS FOR MANIPULATING FLAT ARTICLES, SUCH AS SHEETS OF PAPER, PLASTIC, CARDBOARD AND THE LIKE

(76) Inventor: Jürg Paul Haller, Madrid (ES)

( * ) Notice: Subject to any disclaimer, the term of this patent is extended or adjusted under 35 U.S.C. 154(b) by 222 days.

(21) Appl. No.: 12/304,786

(22) PCT Filed: Jun. 15, 2007

(86) PCT No.: PCT/EP2007/005288
§ 371 (c)(1),
(2), (4) Date: Jun. 8, 2009

(87) PCT Pub. No.: WO2007/144188
PCT Pub. Date: Dec. 21, 2007

(65) Prior Publication Data

US 2010/0093509 A1 Apr. 15, 2010

(30) Foreign Application Priority Data

Jun. 15, 2006 (DE) ..... 10 2006 028 123

(51) Int. Cl.
*B31B 1/34* (2006.01)

(52) U.S. Cl.
USPC ..... 493/454; 493/405; 493/416; 493/442; 493/8; 493/424

(58) Field of Classification Search ..... 493/405, 493/416, 442, 454, 3, 8, 424
See application file for complete search history.

(56) References Cited

U.S. PATENT DOCUMENTS

| | | | | |
|---|---|---|---|---|
| 5,539,511 | A * | 7/1996 | Wenthe et al. | 399/361 |
| 5,848,347 | A * | 12/1998 | Kuo et al. | 399/406 |
| 5,947,467 | A * | 9/1999 | Billings et al. | 271/188 |
| 5,967,963 | A | 10/1999 | Götting | |
| 5,980,443 | A | 11/1999 | Kayser | |
| 6,024,682 | A | 2/2000 | Mandel | |
| 6,592,506 | B1 | 7/2003 | Lyga | |
| 6,730,010 | B2 * | 5/2004 | Yamakawa et al. | 493/267 |
| 7,326,166 | B2 * | 2/2008 | Sytema | 493/421 |
| 7,537,558 | B2 * | 5/2009 | Vono et al. | 493/443 |
| 2003/0040415 | A1 | 2/2003 | Yamakawa | |
| 2012/0193859 | A1 * | 8/2012 | St. Ours et al. | 270/20.1 |

FOREIGN PATENT DOCUMENTS

| | | | |
|---|---|---|---|
| DE | 41 23 499 | A1 | 1/1993 |
| EP | 0 391 548 | A | 10/1990 |
| EP | 0 844 205 | | 5/1998 |
| EP | 1 431 223 | A | 6/2004 |
| GB | 441 557 | | 1/1936 |
| GB | 2 069 981 | A | 9/1981 |
| JP | 2006 076779 | A | 3/2006 |
| WO | 03/070612 | A | 8/2003 |
| WO | 2004/069710 | A | 8/2004 |

* cited by examiner

*Primary Examiner* — Christopher Harmon
(74) *Attorney, Agent, or Firm* — Gudrun E. Huckett

(57) ABSTRACT

A device for manipulation of flat articles such as sheets of paper, plastic, cardboard and the like has at least one adjustable conveying unit with conveying elements, especially rollers. The at least one conveying unit is adjustable between at least two positions for performing at least two manipulations on the article. At least one switch that is adjustable between at least two positions for performing at least two manipulations on the article is provided.

6 Claims, 16 Drawing Sheets

F4

APPARATUS FOR MANIPULATING FLAT ARTICLES, SUCH AS SHEETS OF PAPER, PLASTIC, CARDBOARD AND THE LIKE

BACKGROUND OF THE INVENTION

The invention concerns an apparatus for manipulating flat articles such as sheets of paper, plastic, cardboard and the like, comprising conveying elements, in particular rollers.

In the manipulation of printed sheets, for example, for folding, devices are used that are provided with folding pockets. With such folding pockets it is only possible to process a predetermined sheet size and a certain folding variant. While operating, only the set number of the products, i.e., the number of collected sheets e.g. for each mailing, can be varied. When the sheet size or the folding variant is to be changed, the machine must be stopped and newly adjusted or retrofitted so that undesirable downtimes result. Also, mixed variable products by so-called print on demand cannot be produced.

Such a folding apparatus is disclosed in EP 0 844 205 B1.

In order to enable a change of the folding variant during operation, it has already been attempted to install parallel systems in a machine which systems can be activated as needed; however, this requires a great expenditure and a large space.

Moreover, it has been attempted to supply pre-manufactured semi-finished products (for example, advertisement or other inserts) on a special transport stretch to the mailing to be produced which however requires also a great expenditure, a large space, and complex logistics for providing and supplying the correct product to the correct mailing. Producing mixed variable products by so-called print on demand is also not possible with these solutions.

The invention has therefore the object to provide a device as well as a machine provided therewith which the manufacture of selectively combined products, for example, mailings, is possible in a simple way with a great variety of variants.

SUMMARY OF THE INVENTION

The object is solved according to the invention in that the conveying elements are part of at least one adjustable conveying unit that, for performing at least two manipulations on the article, is adjustable between at least two positions. This object is further solved in accordance with the present invention in that the device has at least one switch that is adjustable between at least two positions for performing at least two manipulations on the article.

With the device according to the invention, it is possible to variably prepare and process the articles. Since the conveying elements can be adjusted between the different positions, the articles can be prepared and processed differently. For example, depending on the adjustment different folding types can be produced and/or the fold lengths can be changed. The conveying elements can also be adjusted such that the articles are transported without processing through the device. In this connection, the articles can also be diverted or the articles can be turned individually or combined two sets. In this connection, the device can be adjusted from article to article as needed so that sequentially supplied articles can be subjected to different processing steps.

With the adjustable switch it is also possible to process the article selectively.

Further features of the invention result from the additional claims, the description and the drawings.

BRIEF DESCRIPTION OF THE DRAWINGS

The invention will be explained in more detail with the aid of some embodiments illustrated in the drawings. It is shown in.

DESCRIPTION OF PREFERRED EMBODIMENTS

The invention will be explained in more detail in the following with the aid of preferred embodiments with reference to the attached drawings.

Figure 1:
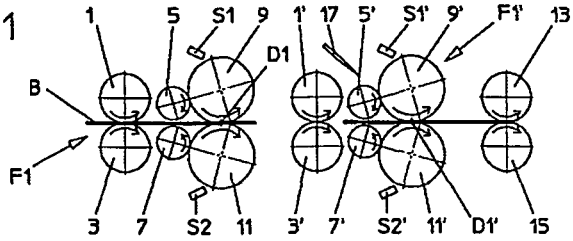
FIG. 1 in schematic illustration two sequentially arranged devices according to the invention embodied as folding devices through which the article is transported without being processed.

In FIGS. 1 to 9 different applications of a folding device are illustrated. As can be seen in FIG. 1, two pocket-less folding devices F1 and F1' according to the invention are sequentially arranged. In each of the folding devices there are two intake rollers, folding rollers, and auxiliary rollers each arranged axis-parallel to one another and rotatably supported and driven by servo motors. The intake rollers 1, 3; 1', 3' are supported directly on the frame (not illustrated) while the auxiliary rollers 5, 7; 5',7' and the folding rollers 9, 11; 9', 11' are supported on a pivot frame that is also not illustrated which, in turn, is pivotably supported on the frame about pivot point D1. The auxiliary rollers 5, 7; 5', 7' have identical diameter that is however smaller than the diameter of the two folding rollers 9, 11; 9', 11'.

The following function results: A sheet B is gripped by the intake rollers 1, 3 of the first folding device F1 and supplied past the auxiliary rollers 5, 7 to the folding rollers 9, 11 and transported by them farther to the intake rollers 1', 3' of the second folding device F1'. The sheet B also passes through the second folding device F1' without being folded and is transported farther by the transport rollers or intake rollers 13, 15 of a further module. This function illustrates that machines can be combined from modules that are arranged in series and illustrates that certain sheets can pass the machine without the folding function being employed. In this way, the desired production of printed sheet products by print on demand is made possible.

Figure 2:
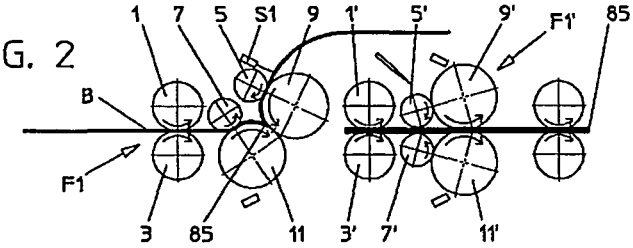
FIG. 2 the devices according to FIG. 1 producing a V fold on the article.

In FIG. 2, the pivot frame of the first folding device is pivoted about the pivot axis D1 in the clockwise direction such that the sheet B, initially coming from the intake rollers 1, 3, is guided outwardly through the auxiliary roller 8 and the folding roller 11 as well as the auxiliary roller 5 and the folding roller 9 until a length that is required for folding is reached. This required length is detected by sensor S1 and, subsequently, the auxiliary and the folding rollers 5, 9 change their direction of rotation. While the auxiliary and folding rollers 7, 11 continue to push the sheet in unchanged direction, the leading part of the sheet is pushed by the auxiliary and folding rollers 5, 9 in the opposite direction so that in the sheet a bulge 85 is formed that reaches the nip between the folding rollers 9, 11 and is folded to the so-called V fold. The folded sheet passes through the second folding device F1' without further processing and is then transported farther by the rollers 13, 15 to the downstream module of the machine.

Figure 3:
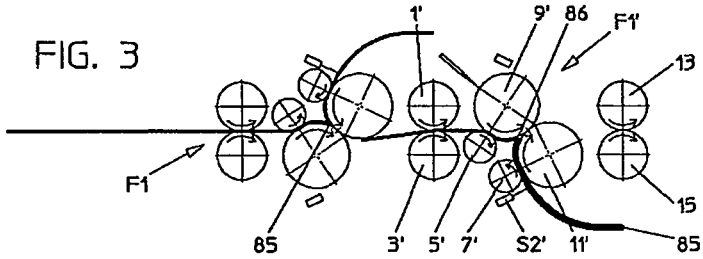
FIG. 3 in an illustration corresponding to that of FIG. 1 the manufacture of a Z fold on an article with the devices according to the present invention as shown in FIG. 1.

In FIG. 3, by means of the two folding devices F1 and F1' a so-called Z fold is produced. First, in the folding device F1, as described above, at the leading third of the sheet a V fold is formed. The thus pre-folded sheet is then guided by the intake rollers 1', 3' of the second folding device F1', with the pivot frame being pivoted counterclockwise downwardly, between the auxiliary roller 5' and the folding roller 9' and farther between the auxiliary roller 7' and the folding roller 11'. When the sensor S2' detects the correct position for folding of the pre-folded sheet, the rotational direction of the auxiliary roller 7' and of the folding roller 11' is reversed so that the sheet begins to bulge (bulge 86), is pulled into the nip between the folding rollers 9', 11', and is finished by forming the Z fold. The rollers 13 and 15 further convey the sheet folded in this way. The sheet B has thus two folds 85, 86.

Figure 4:
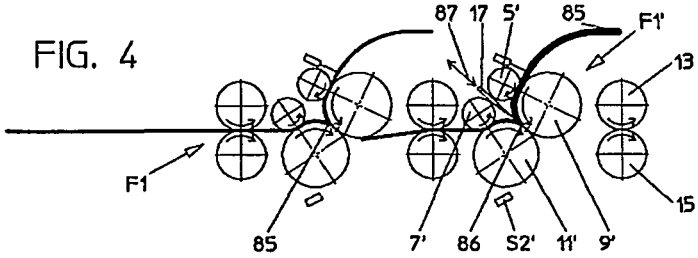
FIG. 4 in an illustration corresponding to FIG. 1 the two devices producing a C fold on the article.

In FIG. 4, finally the formation of a so-called C fold in folding devices according to the invention is illustrated. In the folding device F1 first, as already explained, a V fold 85 is formed that is provided at the end of the leading third of the sheet. The pre-folded sheet is then supplied to the second folding device F1' with the pivot frame being pivoted upwardly in the clockwise direction. The sheet passes through the nip between the auxiliary roller 7' and the folding roller 11' as well as the nip between the auxiliary roller 5' and the folding roller 9' until the sensor S2' detects the correct initial position of the sheet for creating the C fold and triggers reversal of the rotational direction of the auxiliary roller 5' end of the folding roller 9'. In this way, again a bulge 86 of the sheet in the direction toward the nip between the folding rollers 9' and 11' is effected. The leading edge of the folded sheet is however not entrained as the bulge is produced and is thus not pulled into the nip between the two folding rollers 9' and 11'. For this reason, in the frame of the folding device F1' a folding element 17 is provided that is linearly reciprocatingly movable (arrow 87) in the frame transverse to the folding nip between the folding rollers 9', 11' and upon reversal of movement direction of the rollers 5' and 9' is advanced briefly in the direction of the nip between the rollers 9' and 11' so as to guide the sheet edge into the nip. After passing through the rollers 9' and 11', the C fold is completed and the sheet can be further transported by means of the rollers 13, 15 to the next module of the machine. The folded sheet parts of a C fold rest immediately on one another.

Figure 5:
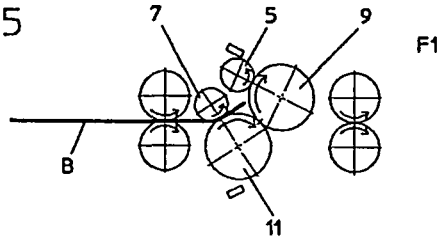
FIG. 5 to FIG. 9 in a schematic illustration five positions of the device according to the invention for producing a V fold.

For a better understanding, the manufacture of a V fold in a folding device according to the invention without pocket in accordance with claim 1 is illustrated in FIGS. 5 to 9 in five intermediate positions:

FIG. 5 shows the incoming sheet B in the folding device F1 with upwardly pivoted pivot frame so that the sheet B is first gripped by the rollers 7, 11 and transported farther in the direction toward the rollers 5, 9.

Figure 6:
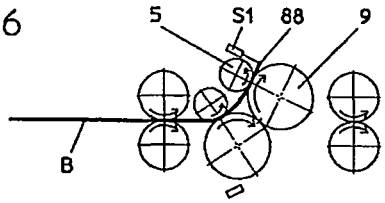

In FIG. 6 the sheet is already between the rollers 5, 9 and the sensor S1 detects momentarily the leading edge 88 of the sheet B.

Figure 7:
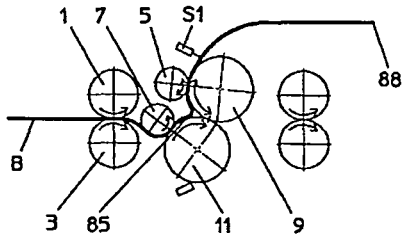

FIG. 7 shows the moment at which the sensor S1 detects the required spacing relative to the leading edge 88 for forming the V fold and has just initiated reversal of the rotational direction of the rollers 5, 9. A bulge 85 of the sheet B in the direction toward the nip between the folding rollers 9, 11 can be easily recognized. The pivot frame, in comparison to the position according to FIG. 6, has been partially returned counterclockwise. The auxiliary roller 7 is located at the level of the roller nip between the two intake rollers 1, 3.

Figure 8:
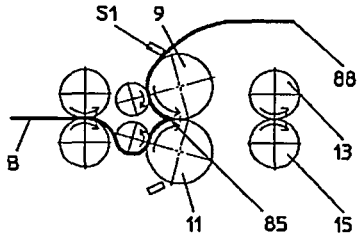
Figure 9:
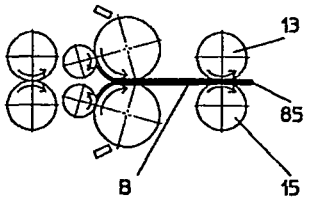

Finally, in FIG. 8 the return pivot action of the pivot frame into the initial position according to FIG. 1 at the moment of pulling the fold 85 between the folding rollers 9, 11 can be seen. The sheet B is in this way deflected downwardly so that the fold formation between the folding rollers 9, 11 is facilitated. Subsequently (FIG. 9), the folded sheet is gripped by the rollers 13, 15 and transported farther to the next processing module.

Figures 10, 11, 12:
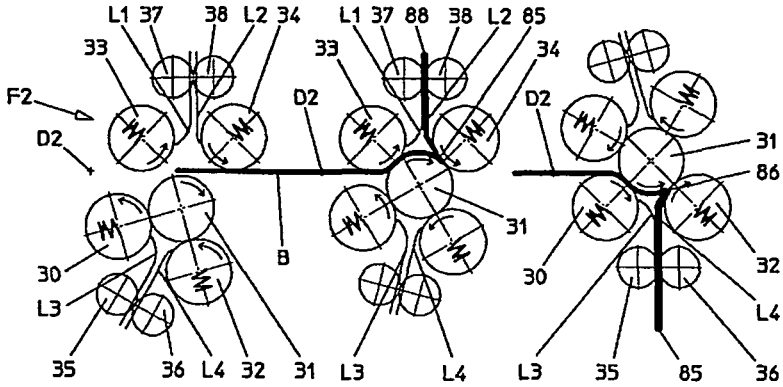
FIG. 10 to FIG. 12 three sequentially arranged devices according to the invention in schematic illustration.

In FIGS. 10 to 12 a further embodiment of a folding device F2 according to the invention is illustrated in which in a frame (not illustrated) the folding and auxiliary rollers are rotatably supported each in an upper and a lower pivotable frame (also not illustrated) about pivot point D2. The upper pivot frame supports two folding rollers 33, 34 and two auxiliary rollers 37, 38 and comprises two immobile first guiding elements L1 and L2 that secure in certain positions of the folding rollers the further transport of the sheets B between the auxiliary rollers 37, 38 of the upper pivot frame. The auxiliary rollers 37, 38 of same size have again a smaller diameter than the folding rollers 33, 34 of same size. The guiding elements L1, L2 extend parallel to one another between the two auxiliary rollers 37, 38. Their lower ends are outwardly bent in opposite directions relative to one another so that a funnel-shaped widened insertion opening for the sheets B is formed between folding rollers 33, 34.

The lower pivot frame supports three folding rollers 30, 31, 32 and two auxiliary rollers 35, 36 and has two immobile second guiding elements L3, L4 that also ensure, as a function of the position of the folding rollers relative to one another, further transport of the sheets B between the auxiliary rollers 35, 36 of the lower pivot frame. The auxiliary rollers 35, 36 of same size have a smaller diameter than the folding rollers 30 to 32 of same size. The guiding elements L3, L4 extend also parallel to one another between the two auxiliary rollers 35, 36. In the area between the folding rollers 30, 32 the ends of the guiding elements L3, L4 for forming a funnel-shaped, widening insertion opening are curved outwardly in opposite directions to one another.

In FIGS. 10 through 12 the sequential arrangement of three folding devices F2 is illustrated.

In FIG. 10, the lower pivot frame with the folding rollers 30, 31, 32 is pivoted downwardly and a sheet B being fed between the folding rollers 33 and 34 of the upper pivot frame and the folding roller 31 of the lower pivot frame is passing through without being processed.

In FIG. 11 the lower pivot frame has been pivoted about pivot axis D2 toward the upper pivot frame so that the folding roller 31 interacts with the folding rollers 33 and 34 of the upper pivot frame.

The incoming sheet B reaches the nip between the folding rollers 33 and 31 and from there the area between the guiding elements L1 and L2. They guide the sheet B between auxiliary rollers 37 and 38. A sensor (not illustrated) detects the leading edge 88 of the sheet and reverses the auxiliary rollers 37 and 38 with respect to their rotational direction as soon as the folding length for the leading part of the sheet B is reached. By reversing the auxiliary rollers 37, 38 a bulge 85 of the sheet is formed in the direction toward the nip between the folding rollers 31 and 34 until the bulge 85 is pulled into the nip, the sheet is folded, and transported farther to the downstream folding device in which, according to FIG. 12, the lower pivot frame has been pivoted about the pivot axis D2 even father upwardly and the upper pivot frame has been pivoted about the pivot axis D2 also upwardly. The sheet B that has been pre-folded by the folding device according to FIG. 11 and transported farther now reaches the area between the folding rollers 30 and 31 and is guided into the area between the immobile guiding elements L3 and L4. They, in turn, guide the pre-folded sheet between the auxiliary rollers 35 and 36. A sensor (not illustrated) detects again the leading edge 85 of the pre-folded sheet and reverses the rotational direction of the auxiliary rollers 35 and 36 as soon as the required sheet length for the further fold formation has been received between the auxiliary rollers 35 and 36. The sheet B is bulged by reversal of the auxiliary rollers 35 and 36 in the direction toward the nip between the folding rollers 31 and 32 (bulge 86) and finally pulled into the nip, folded, and transported away or guided to the downstream processing module of the machine A.

The folding rollers 30 and 32 to 34 are advantageously spring-loaded in the direction of the sheet B so that the sheet B is transported without problems between the different rollers. All rollers 30 to 34, 37, 38 are positioned axis-parallel to one another.

Figures 13, 14, 15:
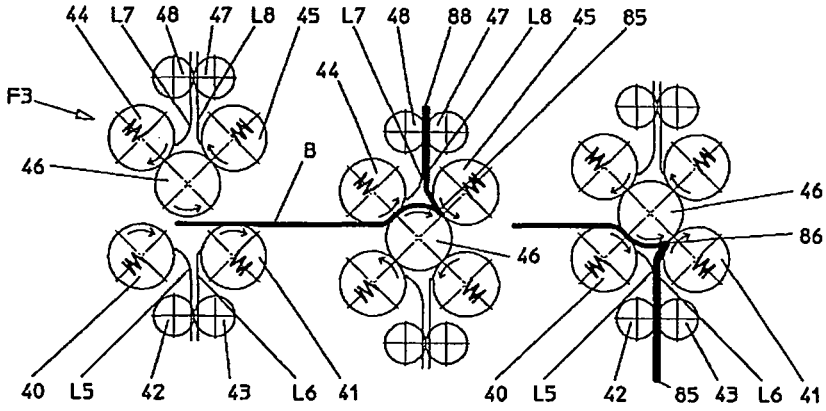
FIG. 13 to FIG. 15 in an illustration corresponding to FIGS. 10 to 12 a further embodiment of a device according to the invention.

In FIGS. 13 to 15 a further embodiment of a folding device F3 with its possible functions is illustrated.

The folding device F3 according to the invention comprises a frame (not illustrated) as well as five folding and at least four auxiliary rollers that are all arranged axis-parallel to one another and are rotatably supported. Two of the folding rollers 40, 41 are rotatably supported together with two auxiliary rollers 42, 43 on a first push frame (in the embodiment the lower one). The three remaining folding rollers 44, 45, 46 are rotatably supported together with two auxiliary rollers 47, 48 on a second push frame (in the illustrated embodiments the upper one). The first and second push frames (also not illustrated) are supported in the frame so as to be linearly moveable relative to one another as well as with one another. On each push frame there are also immobile guiding elements attached that guide the sheet B from the folding rollers to the auxiliary rollers as well as back to the folding rollers. The folding rollers of each push frame have same diameter that is greater than the diameter of the auxiliary rollers of same size of each push frame. The folding rollers 40, 41, 44, 45 are advantageously spring-loaded in such a way that they transport the sheets B reliably through the folding device F3.

In FIG. 13, the two push frames that are slidably supported in the frame and support the folding and auxiliary rollers rotatably are spaced from one another in that the second (upper) push frame has been pushed upwardly and therefore the folding rollers 40, 41 of the first push frame no longer interact with the folding rollers 44, 45, 46 of the second push frame so that a sheet B of the folding device passes through without being processed and is conveyed to the downstream folding device according to FIG. 14.

In the folding device according to FIG. 14 the second push frame has been moved downwardly toward the first push frame and the second and the first push frames together have been moved farther downwardly. The incoming sheet B thus reaches the area between the folding rollers 44 and 46 of the second push frame and is then guided between the immobile guiding elements L7, L8 upwardly between the auxiliary rollers 47, 48. A sensor (not illustrated) detects, as in the preceding embodiments, the leading edge 88 of the sheet and reverses the auxiliary rollers 47, 48 in their rotational direction as soon as the sheet length required for the first folding action has been received between the auxiliary rollers 47, 48. By reversing the auxiliary rollers 47, 48 the sheet B bulges at the folding location in the direction toward the nip between the folding rollers 45, 46, is pulled into the nip, folded (fold 85) and transported away or conveyed to the folding device according to FIG. 15.

In comparison to FIG. 14, in the folding device according to FIG. 15 the two push frames have been pushed upwardly. In the folding device illustrated in FIG. 15 the incoming pre-folded sheet B is gripped between the folding rollers 40 and 46 and is guided by the immobile guiding elements L5, L6 of the first push frame between the auxiliary rollers 42, 43. A sensor (not illustrated) detects again the incoming leading edge of the pre-folded sheet and reverses the rotational direction of the auxiliary rollers 42, 43 as soon as the required folding length of the sheet has been received. By reversing the rotational direction of the auxiliary rollers 42, 43 the sheet bulges in the direction toward the nip between the folding rollers 41 and 46 and is pulled in between the folding rollers 41 and 46, folded (fold 86) and transported away or conveyed to the next module of the machine A.

The guiding elements L5 to L8 are identical and arranged in the same way as the guide elements L1 to L4 of the embodiment according to FIGS. 10 to 12.

In FIGS. 16 to 19 the multitude of functional possibilities of a folding device F4, F4', and F4" according to the invention are illustrated.

Figure 16:
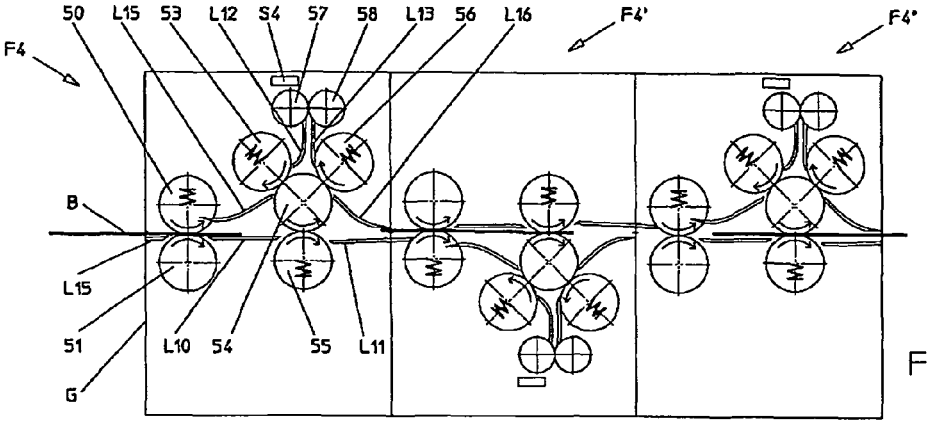
FIG. 16 in schematic illustration folding of a V fold with a device according to the invention.

FIG. 16 shows three folding devices F4' connected in series in which two intake rollers 50, 51, four folding rollers 53, 54, 55, 56, and two reversing rollers 57, 58 are arranged on a frame G axis-parallel to one another and are rotatably supported. On the frame G there are moreover immobile guiding elements L10, L11 as well as movably supported guiding elements L15, L16. The intake roller 50 and the folding rollers 53, 55, 56 are spring-loaded in the direction of the sheet B being transported past them. The immobile guiding elements L10, L11 are arranged horizontally sequentially behind one another and spaced from one another and are positioned at the level of the roller nip between the intake rollers 50, 51.

The sheet B is fed between the intake rollers 50 and 51 and, because the movable guiding element L15 has been pivoted upwardly out of the path of the sheet, is guided on the immobile guiding element L10 toward the folding rollers 54, 55, passes through the folding nip without being processed and is then conveyed by the guiding element L11 to the intake rollers of the folding device F4' arranged downstream. The rollers of this as well as a further downstream folding device F4" are adjusted such that the sheet is transported through the machine without being manipulated or folded. Based on FIG. 16 it is apparent that the folding devices combined in the machine as functional modules are indeed controllable on the fly, i.e., a sheet, as needed, can pass through the modules of the machine without being processed.

Figure 17:
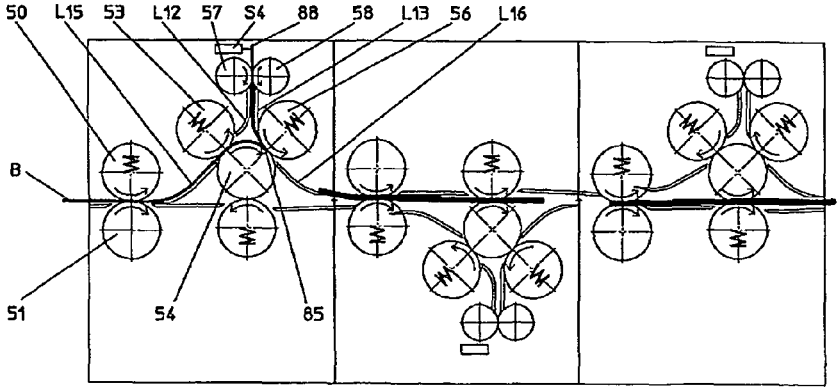
FIG. 17 in an illustration according to FIG. 16 three of the sequentially arranged devices according to the invention for producing a V fold.

FIG. 17 shows the production of a V fold in the folding device F4.

After having passed the intake rollers 50, 51 the sheet B is guided by the movable guiding element L15, that has been pivoted into the movement path of the sheet B, into the nip of the folding rollers 53, 54 and is conveyed by the immobile guiding elements L12, L13 between the reversing rollers 57, 58. The guiding element L15 has an arc-shaped curved end with which it extends into the roller nip between the intake rollers 50, 51. This curved end is positioned at a minimal spacing opposite the guiding element L10. From the arc-shaped end the guiding element L15 extends in this position at a slant upwardly to the folding nip between the folding rollers 53, 54. In this way, the sheet B is reliably guided to the folding rollers 53, 54. After passing through the folding nip, the sheet reaches the funnel-shaped widened insertion opening between the guiding elements L12, L13 that guide the sheet B to the reversing rollers 57, 58. A sensor S4 is provided at the reversing rollers 57, 58 that detects the leading sheet edge 88 and reverses the reversing rollers 57, 58 as soon as the required sheet length for fold formation has passed the reversing rollers. After reversing the rotational direction of the reversing rollers 57, 58, the sheet B bulges in the direction toward the folding nip of the folding rollers 54, 56 and is pulled into the folding nip and folded. The left folding device F4 of FIG. 17 shows the sheet upon entering the folding nip of the folding rollers 54, 56. After the V fold 85 has been formed, the sheet B passes the two additional fording devices F4', F4" without further processing whose rollers are adjusted in accordance with FIG. 16. The guiding element L16 is adjusted such that it extends from the intake rollers 50', 51' of the folding device F4' to the folding rollers 54, 56 of the folding device F4. The guiding element L16 is of the same configuration as the guiding element L15 and guides the folded sheet B reliably to the folding device F4'. Its movable guiding elements L15', L16' are arranged outside of the movement path of the folded sheet.

Figure 18:
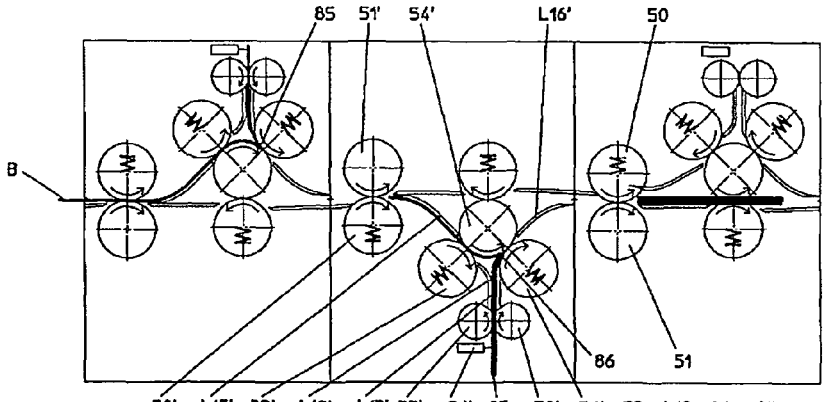
FIG. 18 in an illustration corresponding to FIG. 16 the three sequentially arranged devices according to the invention for producing a Z fold.
Figure 19:
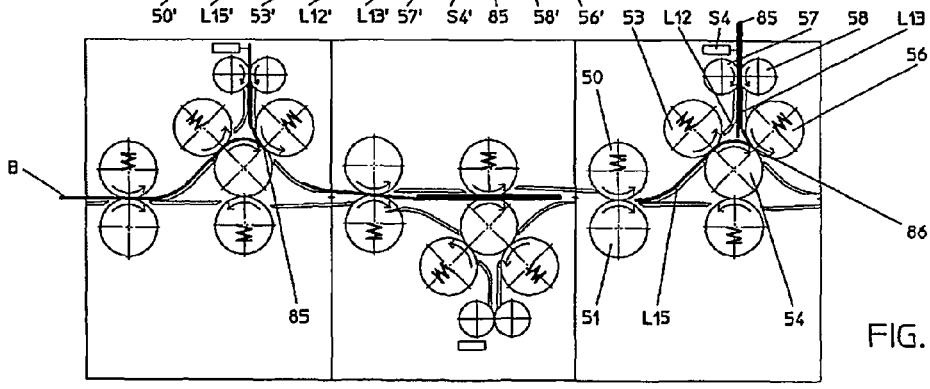
FIG. 19 in an illustration corresponding to FIG. 16 the three devices according to the invention for producing a C fold.

FIG. 18 shows the formation of a Z fold. In the left folding device F4 first, as explained above, a V fold 85 is formed and the sheet with the V fold 85 is further transported to the central folding device F4'. In the central folding device F4' the arrangement of the rollers in the frame G, relative to the arrangement of the rollers in the left folding device F4, is displaced mirror-symmetrically downwardly relative to the horizontal central axis; this is indicated by means of the reference numerals marked with apostrophe. After the sheet B provided with the V fold 85 has passed the intake rollers 50', 51' of the folding device F4', the pre-folded sheet B is guided by means of the guiding element L15', that has been pivoted into the movement path, between the folding rollers 53', 54' and from here by means of the immobile guiding elements L12', L13' to the reversing rollers 57', 58'. At the reversing rollers a sensor S4' is arranged that detects the folded sheet edge 85 and reverses the reversing rollers in their rotational direction as soon as the required sheet length for folding has passed the reversing rollers. By reversing the reversing rollers 57', 58', the sheet is caused to bulge in the direction toward the folding nip of the folding rollers 54', 56' and is pulled into the nip and folded (fold 86) as well as further transported by the movable guiding element L16' to the intake rollers 50, 51 of the folding device F4" to the right. The sheet B provided with the Z fold 85, 86 passes the right folding device F4" without being further processed because it is adjusted as shown in FIG. 16.

in FIG. 19 the formation of a C fold by means of three folding devices F4' to F4" is illustrated. First, in the left folding device F4, as disclosed above, a V fold 85 is formed. The pre-folded sheet B is transported to the central folding device F4' that is adjusted in accordance with FIG. 16 so that the pre-folded sheet B passes through the folding device F4' without being processed. After having entered between the intake rollers 50, 51 of the right folding device F4", the pre-folded sheet is guided by the guiding element L15 that has been pivoted into the movement path to the folding nip of the folding rollers 53, 54 and is transported farther by them by means of the immobile guiding elements L12, L13 between the reversing rollers 57, 58. The sensor S4 at the reversing rollers 57, 58 detects the folded edge 85 of the sheet B and reverses the rotational direction of the reversing rollers 57, 58 at the moment when the required sheet length for the next fold 86 has passed the reversing rollers 57, 58. By reversing the reversing rollers the sheet is caused to bulge at the location 86 to be folded toward the folding nip of the folding rollers 54, 56, is pulled into the folding nip, folded, and transported away or transferred to the next processing module of the machine.

In FIGS. 20 to 24 the function of the reversing roller folding device F4 according to the invention will be explained again step-by-step.

Figure 20:
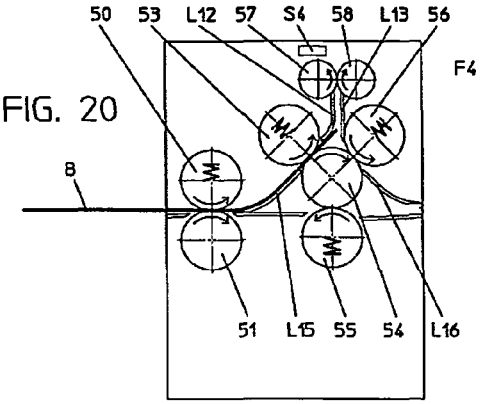
FIG. 20 to FIG. 24 in schematic illustration the production of a V fold with the device according to the invention.

In FIG. 20 the moment is illustrated at which the sheet B has passed the intake rollers 50, 51 and is guided by the guiding element L15 that has been pivoted into the movement path to the folding nip of the folding rollers 53, 54 and supplied to the immobile guiding elements L12, L13.

Figure 21:
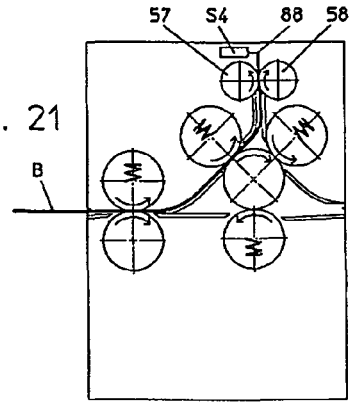

In FIG. 21 the sheet B is guided by the immobile guiding elements L12, L13 to the reversing rollers 57, 58. The sheet B has passed the reversing rollers 57, 58 to such an extent that the sensor S4 has detected the leading edge 88 of the sheet.

Figure 22:
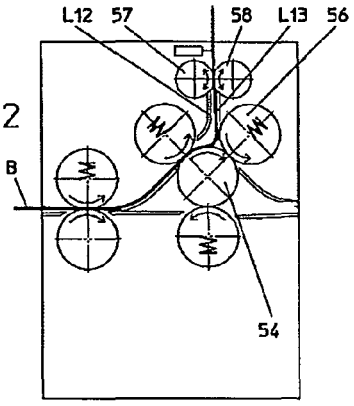

FIG. 22 shows the sheet B shortly after reversing the rotational direction of the reversing rollers 57, 58, i.e., the sheet has passed through the reversing rollers 57, 58 up to the length required for forming a fold. By reversing the reversing rollers 57, 58 the sheet is caused to bulge in a direction toward the folding nip of the folding rollers 54, 56.

Figure 23:
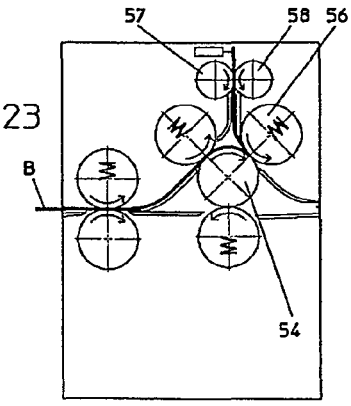

In FIG. 23 the sheet B is just being pulled into the folding nip between the folding rollers 54, 56.

Figure 24:
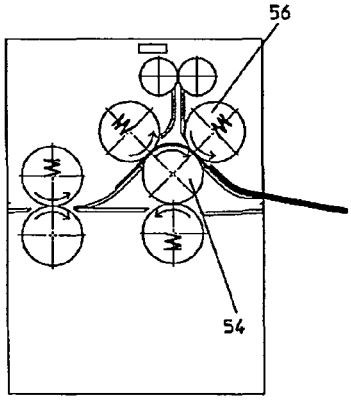

FIG. 24 shows the sheet B that is provided with a V fold as it exits the folding rollers 54, 56. The sheet B is transported away or is transported to a further processing module of the machine.

In FIGS. 25 to 28 the turning of a sheet in a folding device F4 according to the invention is illustrated.

Figure 25:
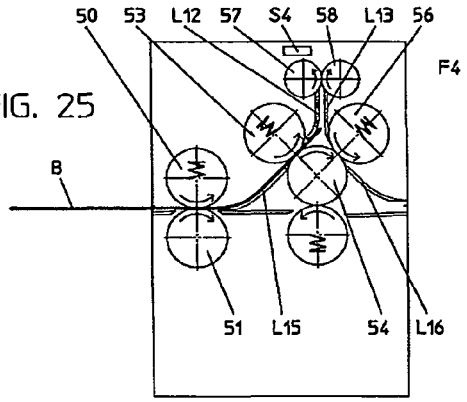
FIG. 25 to FIG. 28 in schematic illustration the adjustment of the device according to the invention for turning the article.

In FIG. 25 the position of the sheet B after gripping the sheet by the intake rollers 50, 51 and after further transport by the guiding element L15 that has been pivoted into the movement path is shown. The sheet has already been gripped by the folding rollers 53, 54 and has been transported farther to the immobile guiding elements L12, L13.

Figure 26:
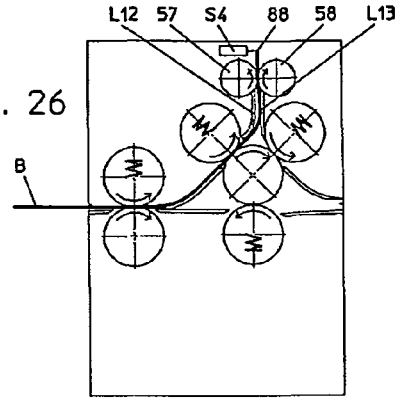

In FIG. 26 the sheet B has been transported farther by the immobile guiding elements L12, L13 to the reversing rollers 57, 58. The sensor S4 arranged at the reversing rollers 57, 58 detects the leading edge 88 of the sheet B.

Figure 27:
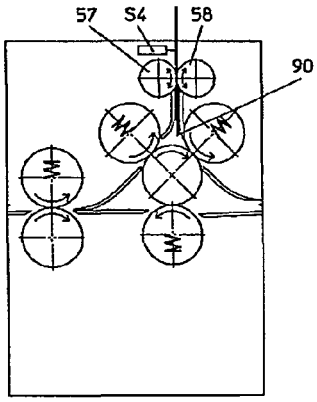

In FIG. 27 the sheet B has passed the reversing rollers 57, 58 to such an extent that the sheet end 90 is free for being returned. This has been detected by the sensor S4 that has triggered reversal of the rotational direction of the reversing rollers 57, 58.

Figure 28:
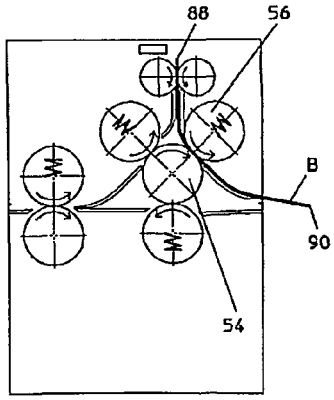

FIG. 28 shows the transport of the turned sheet B after having passed the folding rollers 54, 56. The turned sheet B can be transported away or can be transported to a further processing module of the machine.

Figure 29:
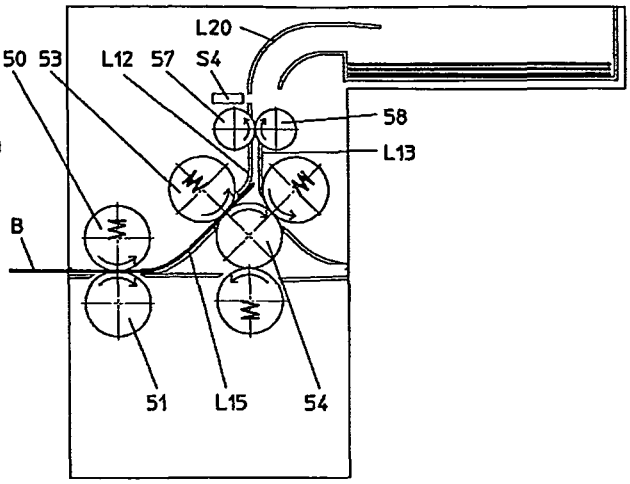
FIG. 29 to FIG. 31 in schematic illustration a device according to the invention with the possibility to divert the article away from the article flow.
Figure 30:
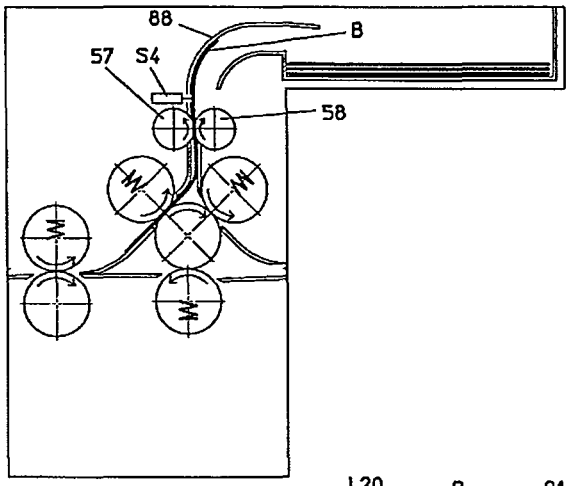
Figure 31:
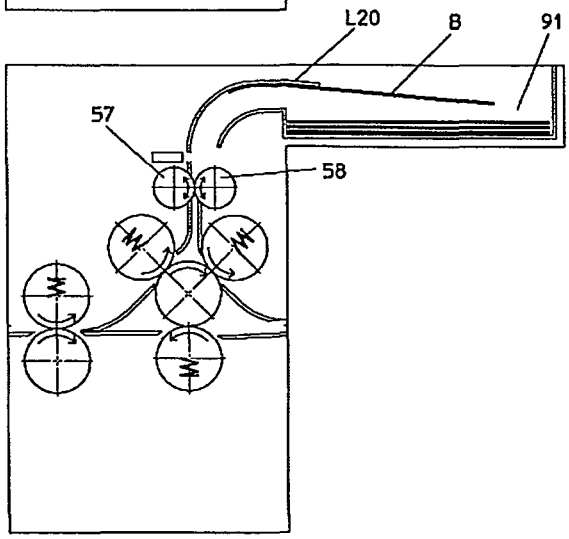

In FIGS. 29 to 31 the use of a folding device F4 according to the invention for diverting a sheet B out of the flow of sheets is illustrated.

FIG. 29 shows the sheet B entering between the intake rollers 50, 51 and the further transport by means of the guiding element L15 that has been pivoted into the movement path to the folding rollers 53, 54 and farther to the immobile guiding elements L12, L13 with which the sheet B is guided to the reversing rollers 57, 58.

In FIG. 30 the sheet B passes the reversing rollers 57, 58. The sensor S4 has detected the leading edge 88 of the sheet. Because the sheet, based on a command that can be provided by manual input, voice input or in any other way, is to be diverted, the sensor S4 in this case will not reverse the rotational direction of reversing rollers 57, 58.

FIG. 31 shows that the sheet B is guided by a further immobile guiding element L20 that is arranged above the reversing rollers 57, 58 to a disposal 91. The guiding element L20 is curved and deflects the sheet B after having passed through the reversing rollers 57, 58 approximately at a right angle to the disposal 91. The end of the guiding element L20 that is facing the reversing rollers 57, 58 is positioned on an extension of the end of the guiding element L12 facing the reversing rollers 57, 58. In this way, the sheet 3 is reliably received by the guiding element 20.

Figure 32:
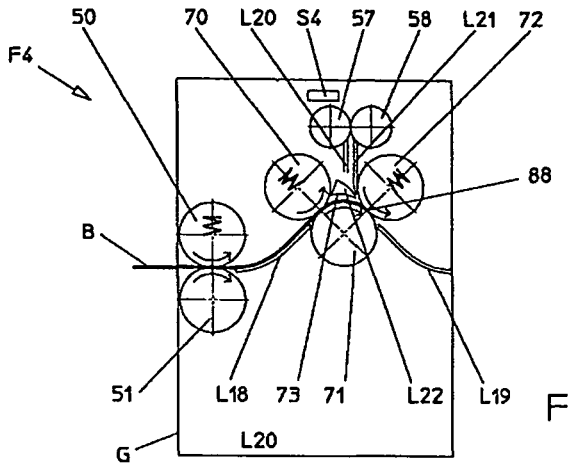
FIG. 32 to FIG. 34 in schematic illustration a device according to the invention showing different adjustments.
Figure 33:
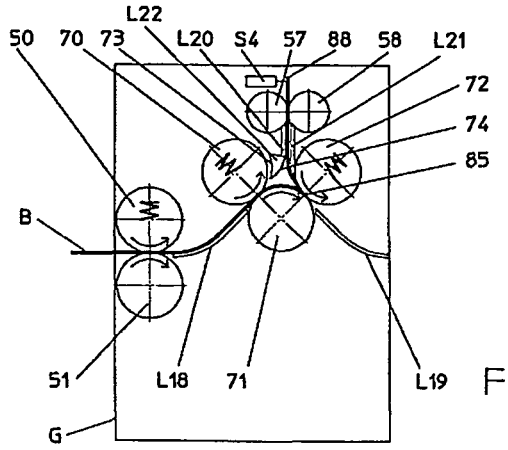
Figure 34:
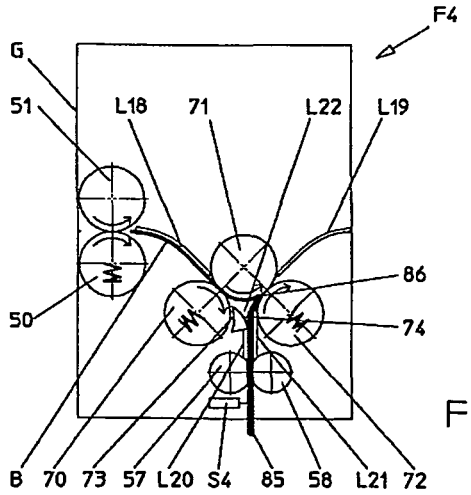

FIGS. 32 to 34 show a further folding device F4. It comprises two intake rollers 50, 51, three folding rollers 71, 72, and two reversing rollers 57, 58. Moreover, this embodiment of the folding device has four immobile guiding elements L18, L19, L20, and L21, a removable guiding element L22 as well as a sensor S4. The intake roller 50 and the folding rollers 70, 72 are spring-loaded in the direction of the sheet B passing through them.

First, FIG. 32 will be explained. After the sheet B has entered the intake rollers 50, 51, the sheet is guided by the immobile guiding element L18 between the folding rollers 70, 71. The guiding element L18 is curved in such a way that it receives the sheet B after having passed the roller nip between the intake rollers 50, 51 and guides it to the folding nip between the folding rollers 70, 71. After passing the folding rollers 70, 71 the leading edge 88 of the sheet is guided by the guide element L22 that is movably supported on the frame G to the folding nip of the folding rollers 71, 72. The guiding element L22 is positioned in the area between the folding rollers 70, 72 and has a curved guiding surface 73 that is facing the guiding roller 71 and has approximately the same radius of curvature as said roller. The sheet B is guided across the guiding surface 73 to the folding nip between the folding rollers 71, 72. The sheet B passes the folding nip between the folding rollers 71, 72 without being processed and is guided away by the immobile guiding element L19 arranged on the frame G or supplied to a further processing module of the machine. The guiding element L19 receives the sheet B as it exits from the roller nip between the folding rollers 71, 72.

In FIG. 33 the production of a V fold is illustrated. After having entered the intake rollers 50, 51, the sheet B is received by the guiding element L18 and transferred to the folding rollers 71. The guiding element L22 is adjusted such that its guiding surface 73 faces the folding roller 70 and a further curved guiding surface 74 that adjoins at an acute angle the guiding surface 73 supplies the sheet B to the immobile guiding elements L20, L21 arranged on the frame G. The guiding surface 74 adjoins the lower end of the guiding element L20 in FIG. 33 so that the sheet B is guided safely between the two guiding elements L20, L21 extending parallel to one another. By means of the latter, the sheet B is transported to the roller nip between the reversing rollers 57, 58 and is passed through it upwardly. The sensor S4 detects the leading edge 88 of the sheet B and reverses the rotational direction of the reversing rollers 57, 58 as soon as the sheet length required for the fold has entered the reversing rollers. By reversing the rotational direction of the reversing rollers 57, 58, the sheet B is caused to bulge at the folding location and pulled into the folding nip of the folding rollers 71, 72 and folded. After folding, the sheet B is transported away by the immobile guiding element L19 or is supplied to a downstream processing module of the machine.

In FIG. 34 the production of a Z fold in the folding device F4 is illustrated.

A pre-folded sheet B provided with the fold 85, for example, coming from the folding device according to FIG. 33, is inserted into the folding device F4 according to FIG. 34 and is supplied by the intake rollers 50, 51 through the immobile guiding element L18 to the folding rollers 70, 71 and father to the reversing rollers 57, 58. In contrast to FIGS. 32 and 33, the folding rollers 70 to 72 and the reversing rollers 57, 58 with the guiding elements L18 to L22 are arranged in a position rotated by 180 degrees. The guiding element L22 is adjusted such that the guiding surface 73 is facing the folding roller 70 and the guiding surface 74 adjoins the now upper end of guiding element L20. Between the guiding elements L20, L21 the sheet B is supplied to the roller nip between the reversing rollers 57, 58. The sensor S4 detects the folded leading edge 85 of the sheet and reverses the rotational direction of the reversing rollers 57, 58 as soon as the sheet length required for folding has been reached. By reversing the rotational direction of the reversing rollers 57, 58 the sheet is caused to bulge at the folding location in the direction toward the folding nip of the folding rollers 71, 72. The folding rollers 71, 72 pull the bulging sheet edge in and form the fold 86. The sheet B now provided with a Z fold is then guided away by the immobile guiding element L19 arranged on the frame G or is supplied to a further processing module of the machine.

In FIGS. 35 to 40 a further embodiment of a folding device F4 is illustrated.

Figure 35:
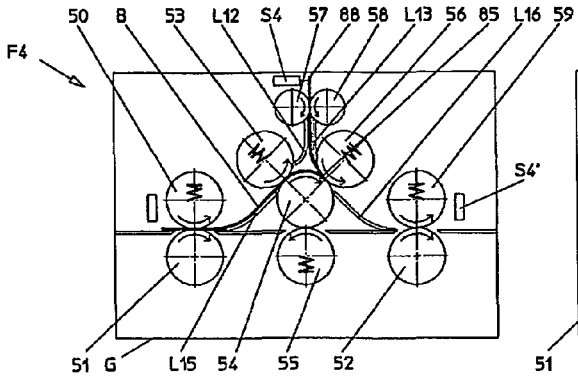
FIG. 35 to FIG. 40 different adjustments of the device according to the invention for processing the article.

FIG. 35 shows that the sheet B after passing the intake rollers 50, 51 is supplied by means of the guiding element L15 that has been pivoted into the movement path and is moveably supported on the frame G to the folding rollers 53, 54 and by means of the immobile guiding elements L12, L13 arranged on the frame G to the reversing rollers 57, 58. A sensor S4 at the reversing rollers detects the leading edge 88 of the sheet and reverses the rotational direction of the reversing rollers 57, 58 as soon as the sheet length required for folding has been pulled in. By reversing the rotational direction of the reversing rollers 57, 58, the sheet is caused to bulge in the direction toward the folding nip of the folding rollers 54, 56 and pulled between the folding rollers 54, 56 and folded (fold 85).

Figure 36:
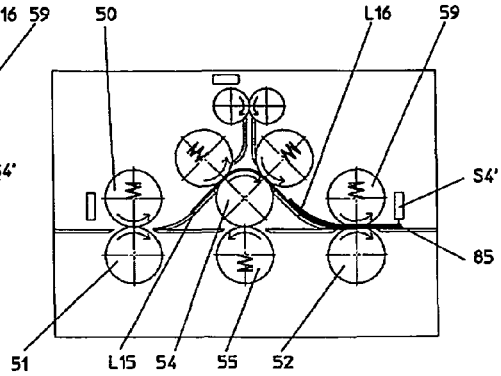
Figure 37:
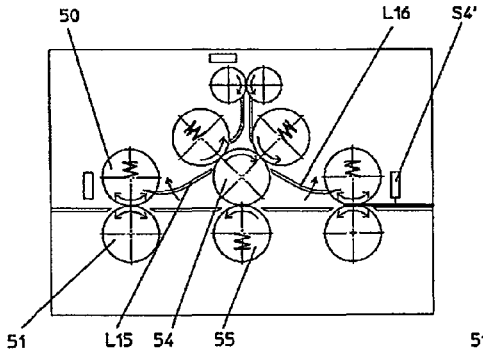
Figure 38:
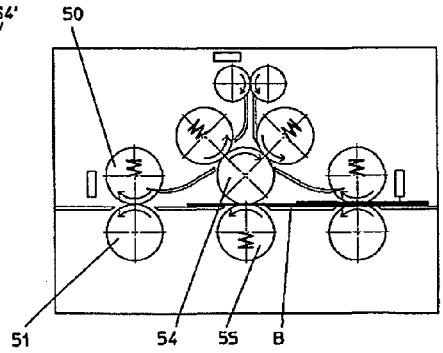
Figure 39:
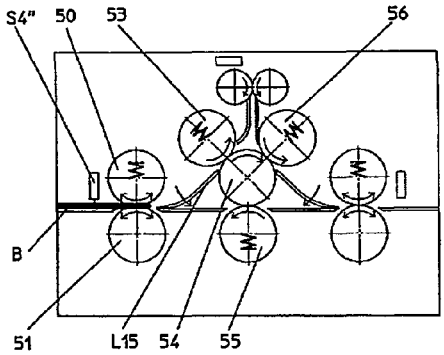
Figure 40:
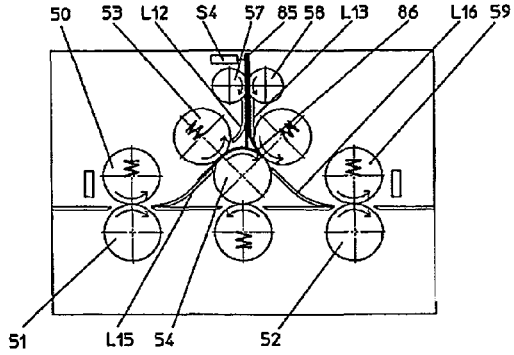

FIG. 36 shows how the sheet B after this pre-folding action is supplied by means of the movably supported guiding element L16 to the folding roller pair 52, 59. The guiding element L16 receives the sheet B after having passed the folding nip between the folding rollers 54, 56 and supplies it to the folding nip between the folding rollers 52, 59. A sensor S4' behind the folding rollers 52, 59 detects again the leading edge 85 of the folded sheet and reverses the rotational direction of the folding rollers 52, 59 as soon as the movably supported guiding element L16 is free of the sheet B. Simultaneous with the reversal of the rotational direction of the folding rollers 52, 59 the movably supported guiding elements L16, L15 are pivoted out of the movement path of the sheet so that the sheet B is moved horizontally between the folding rollers 54, 55 back to the intake rollers 50, 51 (FIGS. 37 and 38). The sheet B, controlled by the sensor S4" in front of the intake rollers 50, 51, is pulled back by the intake rollers 50, 51 until the movably supported guiding element L15 can be pivoted again downwardly into the movement path of the sheet (FIG. 39). Simultaneously with the lowering of the guiding element L15 the rotational direction of the intake rollers 50, 51 is reversed and the pre-folded sheet B is supplied by means of the movably supported guiding element L15, the folding rollers 53, 54, and the immobile guiding elements L12, L13 back to the reversing rollers 57, 58 (FIG. 40). The sensor S4 detects again the leading edge 85 of the pre-folded sheet B and reverses the rotational direction of the reversing rollers as soon as the sheet length required for the second folding action has been pulled in by the reversing rollers 57, 58. Reversal of the rotational direction of the reversing rollers 57, 58 leads to bulging of the sheet at the folding location of the new fold (fold 86) of the sheet illustrated in FIG. 40. The twice folded sheet B is then transported away by the lowered movably supported guiding element L16 and the folding rollers 52, 59 out of the folding device or supplied to a further processing module of the machine.

Figure 41:
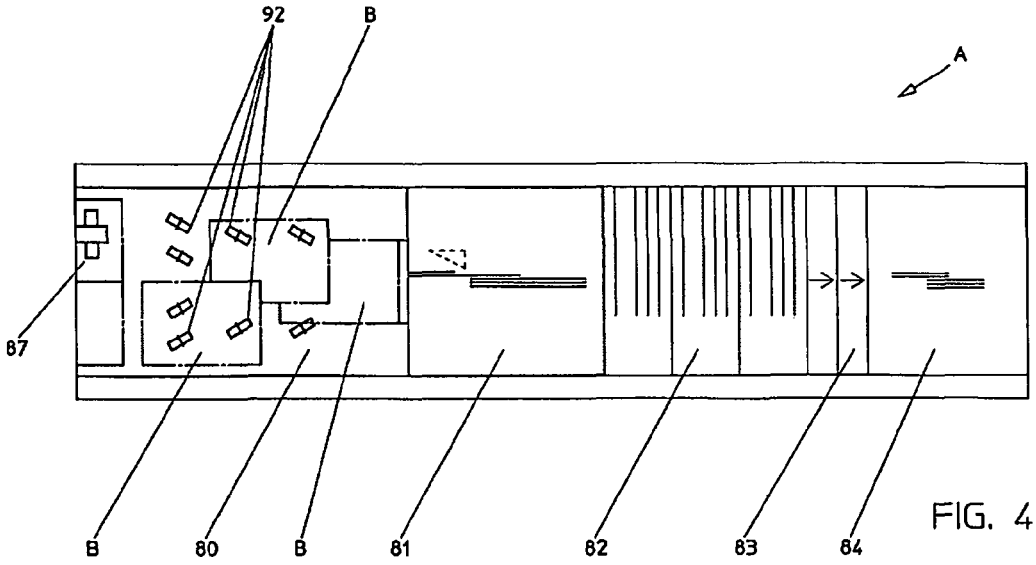
FIG. 41 in a plan view and in schematic illustration a machine for further processing of articles with devices according to the invention.

FIG. 41 shows an embodiment of a machine A for further processing of printed sheets for producing printed sheet products, for example, mailings.

The machine is of a modular design and comprises an intake module 80, an accumulator module 81, a folding module 82 that is comprised of three folding devices according to the invention arranged sequentially behind one another, a buffering module 83 that is comprised of two buffers, as well as a collecting module 84. All modules are arranged in series and are controllable on the fly.

The intake module 80 comprises in the illustrated embodiment a code reader 87 which decodes a code printed on the supplied sheets and that transmits the commands required for the function of the modules to the modules. The intake module comprises moreover a mechanism 92 for imbricating the sheets B. For supplying the sheets B, the mechanism 92 has slantedly positioned rollers that are rotatable about horizontal axes with which the sheets B are positioned on top another in an imbricate arrangement.

Figure 42:
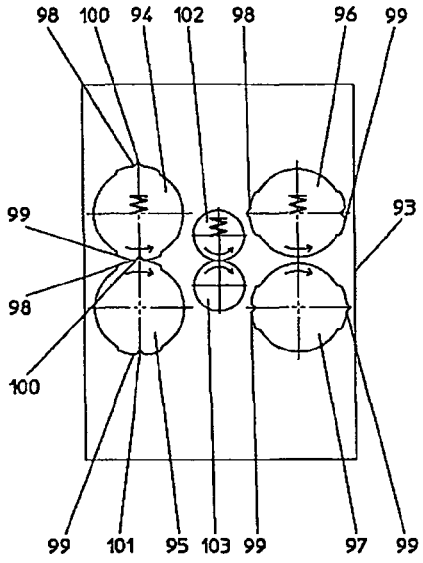
FIG. 42 in schematic illustration a pressing module for processing the article.
Figure 43:
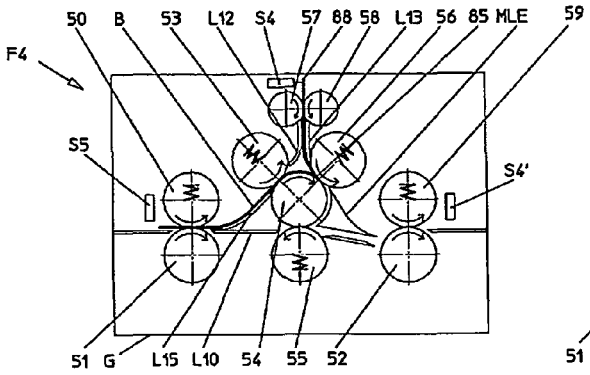
FIG. 43 to FIG. 48 a further embodiment of a device according to the invention with different adjustments.

In the folding module 82 additionally an embossment module 93 according to FIG. 42 can be arranged. When a larger number of sheets is to be folded, the fold locations can be pre-embossed by means of the embossment mechanism 93. The embossment mechanism 93 has two roller pairs 94, 95 and 96, 97 that advantageously have the same diameter and are provided on the circumference with two embossment profiles 98, 99. The embossment profile 98 has a tapering rib 100 projecting from the roller circumference. The embossment profile 99 has a matching recess 101. The embossment profiles 98, 99 are positioned on the rollers 94 to 97 diametrically opposed to one another. For an embossment process the rollers of each roller pair are arranged relative to one another such that after each 180 degree rotation the rib 100 engages the recess 101 as is illustrated for the roller pair 94, 95. The sheet that is passing through these rollers 94, 95 is embossed by the rib 100 in connection with the matching recess 101 at the required location. The folding process that follows in the folding device can be reliably performed as a result of the embossment. This embossment process is in particular advantageous when the folding action is carried out for a high set number and thus with relatively thick products. For example, it is recommended that beginning with sheet 5 or 6 of a sheet stack to emboss the folding edges on the individual sheet before collection in the accumulator module 81.

When an embossment process is not to be performed, the rollers can be rotated into a passing position as illustrated in FIG. 42 for the roller pair 96, 97. The radius of the rollers outside of the embossment profiles 98, 99 is smaller than half the axis spacing of the rollers 96, 97. In this way, the rollers in the passing position are spaced from one another. The embossment profiles 98, 99 are positioned displaced by 90 degrees relative to the embossment position.

When the rollers in the embossment position are in the position illustrated for the rollers 94, 95, an embossment and later on folding in the upward direction is carried out because the rib 100 of the lower roller 95 is pointing upwardly and engages the downwardly open recess 101 of the upper roller 94. When the two rollers 94, 95 are rotated by 180 degrees, the rib 100 of the upper roller 94 is oriented downwardly and engages the upwardly open recess 101 of the lower roller 95. In this case, the embossment and the subsequent folding action are done in a downward direction.

In the gaps between the sequentially supplied sheets the rollers 94 to 97 are rotated into the required position, respectively.

Between the roller pairs 94, 95; 96, 97 there are conveying rollers 102, 103 with which the sheets are transported.

When no pre-embossment is required, the passing position of the embossment device to the right in FIG. 42 can be adjusted on the fly.

By means of the machine A it is possible to produce a variety of different products that are transferred to the machine by print on demand.

The machine A is controlled based on (e.g. programmed) parameters that are predetermined for the individual (different) products to be produced, i.e., the individual modules are controlled and adjusted on the fly for processing each individual product. Each individual product can be produced individually in accordance with the parameters of the control, for example, by a data base or directly by the operator, for example, by display input or voice command.

Based on the FIGS. 43 to 52 one embodiment will be explained in which the sheet B in the folding device F4 is deflected such that without a separate turning process a different kind of fold can be produced. In the embodiment, a Z fold (zigzag fold) is produced.

The embodiment according to FIGS. 43 to 52 corresponds substantially to the embodiment according to FIGS. 35 to 40. It has been described in this connection how by multiple passes in only one folding device F4 a C fold (letter fold) can be produced. The folding device F4 according to FIGS. 43 to 51 differs from this embodiment in that instead of the movable baffle plate like guiding element L16 a multi-guiding element MLE is provided. It is located in the area between the roller pairs 54, 55 and 52, 59. The intake rollers 50, 51 again have the same diameter as the folding rollers 52, 56 and 59. The multi-guiding element MLE has a substantially triangular base member with two curved guiding surfaces 104, 105

(FIG. 49) that adjoin one another at an acute angle, wherein one of the guiding surface 104 has a smaller radius of curvature than the guiding surface 105. At their ends that are facing away from one another the guiding surfaces 104, 105 are connected by a plane guiding surface 106 with one another that is positioned opposite a guiding element 107 that together with the guide surface 106 forms of passage 108 for the sheet B.

In the following, in an exemplary fashion the production of a Z fold will be described that can be produced without a separate turning step by means of the folding device F4 according to FIGS. 43 to 52.

The sheet B is transported between the intake rollers 50, 51 and by means of the movable guiding element L15 is supplied to the fold nip between the folding rollers 53, 54. From here, the sheet B is transported by means of the guiding elements L12, L13 to the reversing rollers 57, 58 between which it is transported in the described way. The sensor S4 that is arranged in the transport direction of the sheet B behind the reversing rollers 57, 58 detects the leading edge 88 of the sheet B and triggers in the described way a switching signal by means of which the reversing rollers 57, 58 are reversed with respect to their rotational direction. The sheet B therefore is caused to bulge in such away that it reaches the folding nip between the two folding rollers 54, 56 so that the fold 85 is formed.

Figure 44:
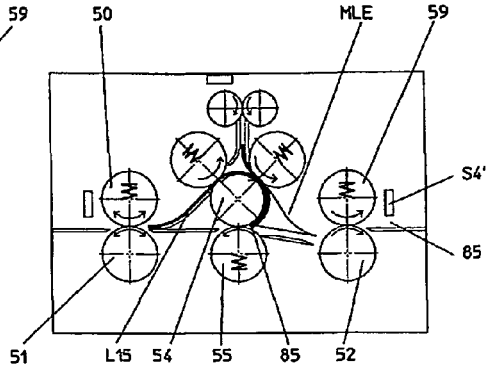
Figure 45:
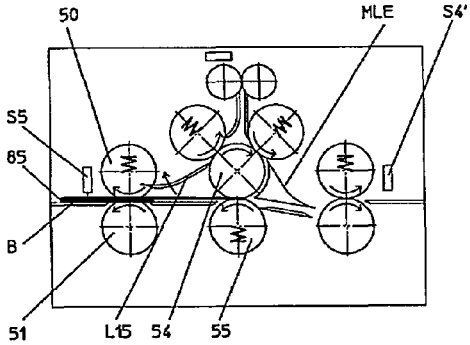
Figure 46:
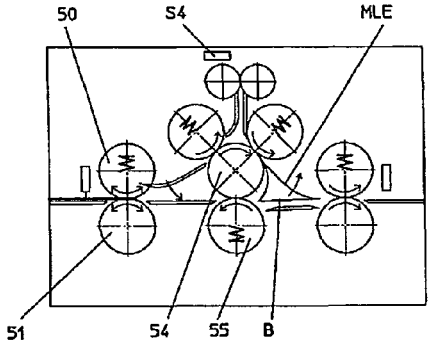
Figure 47:
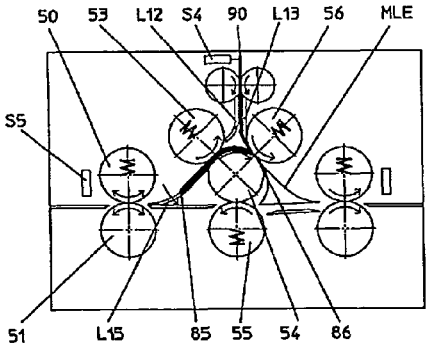
Figure 49:
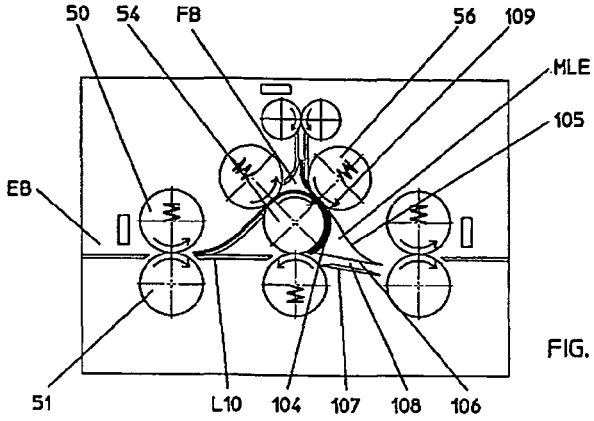
FIG. 49 to FIG. 52 a further embodiment of a device according to the invention in different adjustments.
Figure 50:
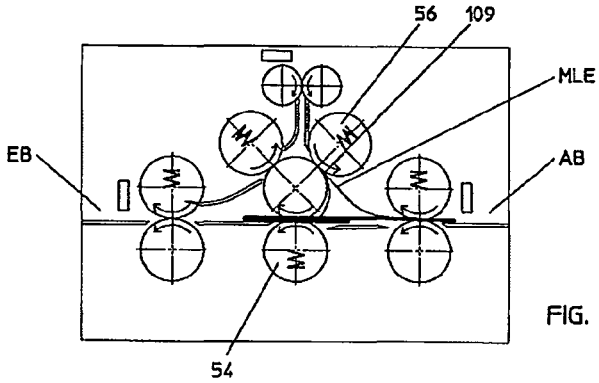

During formation of the first fold 85 the multi-guiding element MLE is adjusted such that the guiding surface 104 is positioned opposite the folding roller 54 at a minimal spacing. Since the guiding surface 104 has the same radius of curvature as the folding roller 54, after the folding step the folded sheet B is transported between the multi-guiding element MLE and the folding roller 54. The connecting edge 109 between the two guiding surfaces 104, 105 is positioned immediately adjacent the folding nip between the folding rollers 54, 56. In this way it is ensured that the fold 85 moves between the multi-guiding element MLE and the folding roller 54. The folded sheet B is thus applied to the folding nip between the folding rollers 54, 56 (FIGS. 44 and 49). By a corresponding adjustment of the multi-guiding element MLE the sheet B is transported out of the folding area FB (FIG. 49) to the intake area EB in front of the intake rollers 50, 51 with simultaneous turning. On the guiding element L10 the single-folded sheet B is supplied to the intake rollers 50, 51 through which the sheet is transported partially. During this return transport of the sheet B the guiding element L15 is pivoted upwardly so that it is no longer within the movement area of the sheet B (FIG. 45). At least one sensor S5 that in transport direction of the sheet B is located in front of the intake rollers 50, 51 detects the sheet B and stops the intake rollers 50, 51 at the moment when the sheet B with its trailing end is still barely within the roller nip between the intake rollers 50, 51 (FIG. 46). Before reversal of the rotational direction of the intake rollers 50, 51 takes place, the guiding element L15 is pivoted back into the movement path of the sheet B (FIG. 46) so that the once-folded sheet B is again transferred by it to the folding nip between the folding rollers 53, 54. After having passed the folding nip, the folded sheet B with its trailing end 90 moves between the guiding elements L12, L13 that supply the sheet to the reversing rollers 57, 58 (FIG. 47).

Advantageously, simultaneous to the return of the guiding element L15 the multi-guiding element MLE is also adjusted about a horizontal axis such that the connecting edge 109 is resting on the wall of the folding roller 54 or at least has such a minimal spacing relative to it that the sheet B after passing through the folding nip between the folding rollers 54, 46 reaches the guiding surface 105 of the multi-guiding element MLE.

Figure 48:
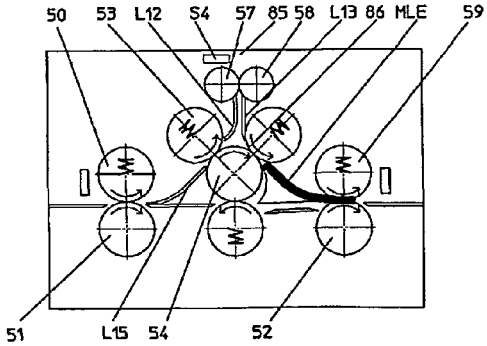
Figure 51:
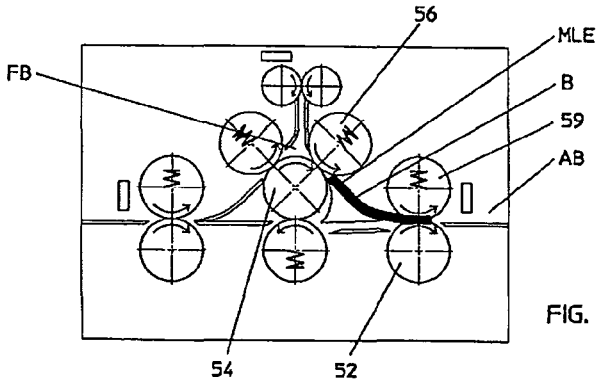

The sensor S4 behind the reversing rollers 57, 58 grips the sheet end 90 and triggers a signal for reversing the rotational direction of the reversing rollers 57, 58. Since the folding rollers 53, 54 are still being driven in the same rotational direction, the sheet B bulges in the folding area FB and enters the folding nip between the folding rollers 54, 56 (FIG. 47). In this way, the second fold 86 is formed upon passing through the folding nip. The now twice-folded sheet B reaches the guiding surface 105 and is transported along it in the direction toward the folding nip between the two folding rollers 52, 59 (FIGS. 48 and 51). Accordingly, the twice-folded sheet B is transported in the conveying direction from the folding area FB (FIG. 51) to the exit area AB (FIG. 51) behind the folding rollers 52, 59. The sheet B provided with the Z fold 85, 86 is transported away or supplied to a following processing module of a machine.

Figure 52:
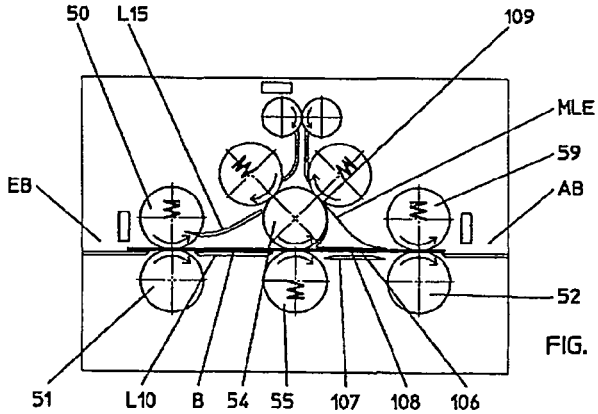

FIG. 52 shows the case that this folding device F4 can also be adjusted such that the sheet B passes through the folding device without being processed, i.e., without folding. In this case, the guiding element L15 is pivoted upwardly out of the movement path of the sheet B. The multi-guiding element MLE is adjusted such that the connecting edge 109 rests against the folding roller 54 and has only minimal spacing. In this position, the passage 108 is positioned between the planar guiding surface 106 and guiding element 107 in the horizontal movement path of the sheet B. Since the guiding element L15 has been pivoted out of the movement path of the sheet B, the sheet B is supplied by means of the intake rollers 50, 51 on the guiding element L10 to the folding rollers 54, 56. They convey the sheet through the downstream passage 108 to the folding rollers 52, 59. After the sheet B has passed through the two folding rollers 52, 59, the unprocessed sheet is transported away from the folding device F4 or is supplied to a following module of a machine.

The multi-guiding element MLE can also be provided in place of the guiding element L15. It is also possible to employ the multi-guiding element MLE in the described position as well as additionally in place of the guiding element L15.

The use of the multi-guiding element MLE has the advantage that the sheet B in the folding device F4 is deflected such that without a separate turning process a different kind of folding, for example, the described Z fold, can be produced. Depending on the adjustment of the folding device F4, the sheet B can also be provided with only one fold. In this case, the multi-guiding element MLE is adjusted in the way disclosed in FIGS. 46 to 48. By means of the sensor S4 the rotational direction of the reversing rollers 57, 58 in this case is switched when a sufficient sheet length for the formation of only one fold has been transported between the reversing rollers 57, 58. Then, by rotational reversal of the reversing rollers 57, 58 and the further drive action of the folding rollers 53, 54 that sheet B is caused to bulge into the folding nip between the folding rollers 54, 56 and in the folding nip the single fold is formed. The multi-guiding element MLE then guides in the position according to FIGS. 46 to 48 the folded sheet to the downstream folding rollers 52, 59.

In the described embodiment one of the intake rollers or the folding rollers is spring-loaded, respectively. This has the advantage that upon passing of the sheet through the roller nip or folding nip a pressure is applied onto the sheet. This is in particular advantageous when two or more sheets are conveyed at the same time through the folding device and folded. It is then possible to apply a satisfactory pressure on the fold.

The machine A that is illustrated in an exemplary fashion in FIG. 41 comprises accumulator 81 with which the sheets B are combined to individual sets. In this connection, one set can be comprised of sheets of different lengths. However, it is also possible that the sheets B are individually sequentially supplied wherein in the accumulator 81 these individuals sheets are either laid on top one another or stacked from the bottom. Also, it is possible to combine individual sets of sheets in the accumulator 81. In this case, it is for example possible to combine the first set of e.g. two sheets with a subsequent set of e.g. six sheets to a single set. Such accumulators are known and are therefore not disclosed in more detail.

Figure 53:
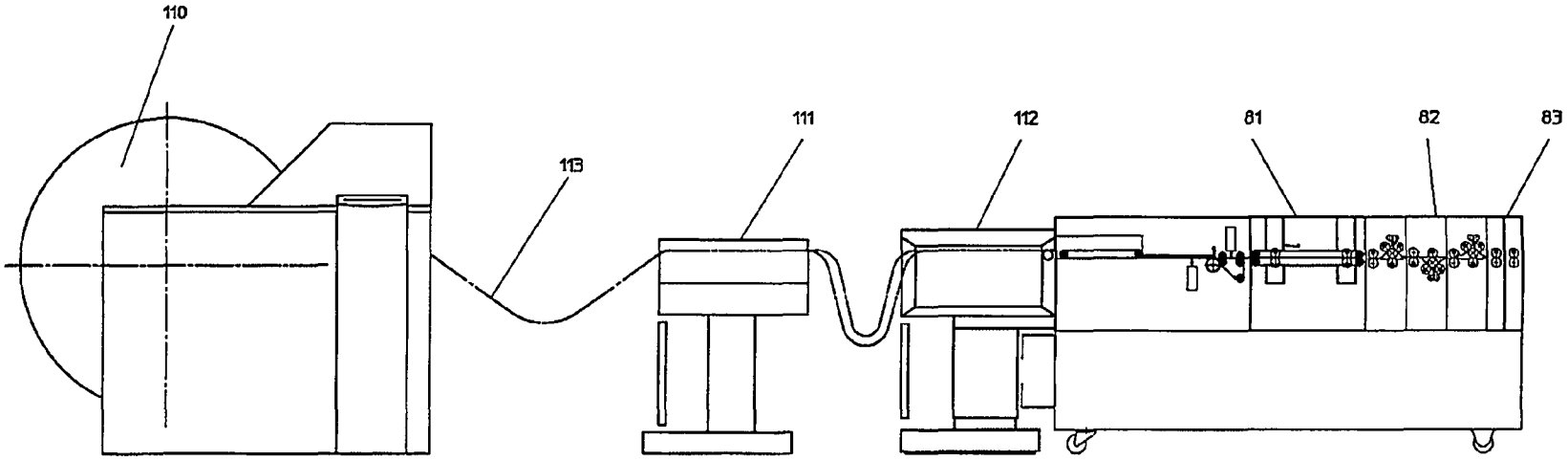
FIG. 53 a side view of a machine for processing articles with devices according to the invention in schematic illustration.
Figure 54:
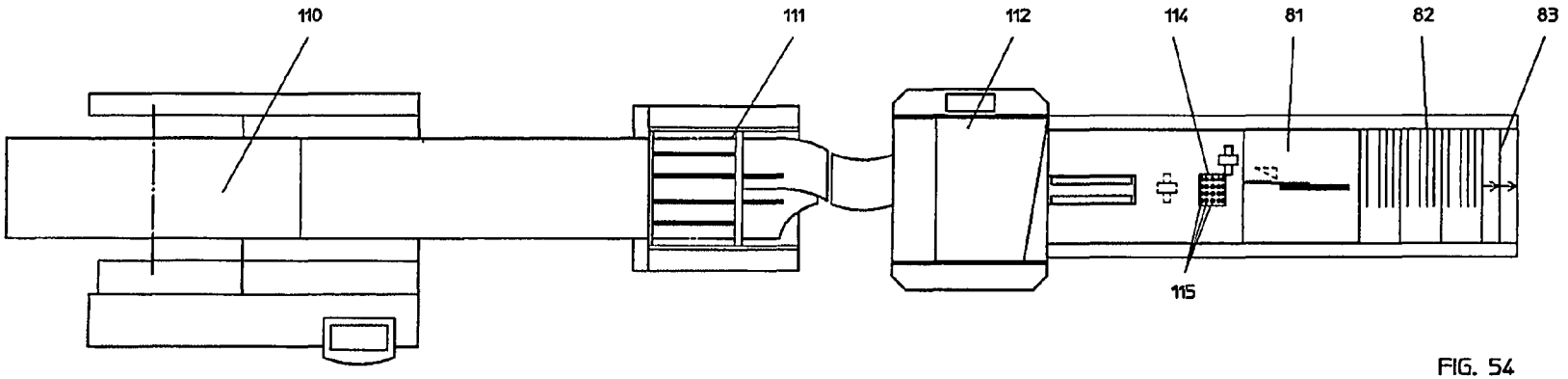
FIG. 54 a plan view onto the device according to FIG. 53.

FIGS. 53 and 54 show in an exemplary fashion a machine with which products are processed that are unwound from a roll 110 and are supplied by means of an intermediate module 111 to a cutting module 112. By means of the cutting module 112 sheets B are cut from the endless web 113 and are supplied by corresponding transport elements 114 (FIG. 54) to the accumulator 81. The transport element 114 is, for example, a roller that is horizontal and positioned perpendicularly to the transport direction of the sheets and has a wall surface provided with passages 115. The roller 114 is connected to a vacuum system with which by means of the passages 115 vacuum is applied to the sheets to be transported. The sheets are thus pulled tightly against the roller 114 that supplies the sheets reliably to the accumulator 81. In the accumulator 81 the sheets are combined e.g. in imbricate arrangement (FIG. 54) and then supplied to the folding module 82. It is comprised of several folding devices, in the embodiment three sequentially arranged ones, with which the sheets or sheet sets are folded in the described way. Downstream of the folding module 82 there is a buffering module 83 with two sequentially arranged buffers.

In this variant the sheets are transported linearly through the different modules of the machine and are folded or transported without being folded, as needed. The folding devices of the folding module 82, as has been explained in connection with the preceding embodiments in detail, can be adjusted as needed and independent from one another in such a way that the desired processing of the sheets is realized. It is possible to adjust all three folding devices in such a way that the sheets are transported without any processing to the buffering module 83. However, all or only some folding devices of the folding module 82 can also be adjusted in the described way in order to achieve the desired folding of the sheets.

Figure 55:
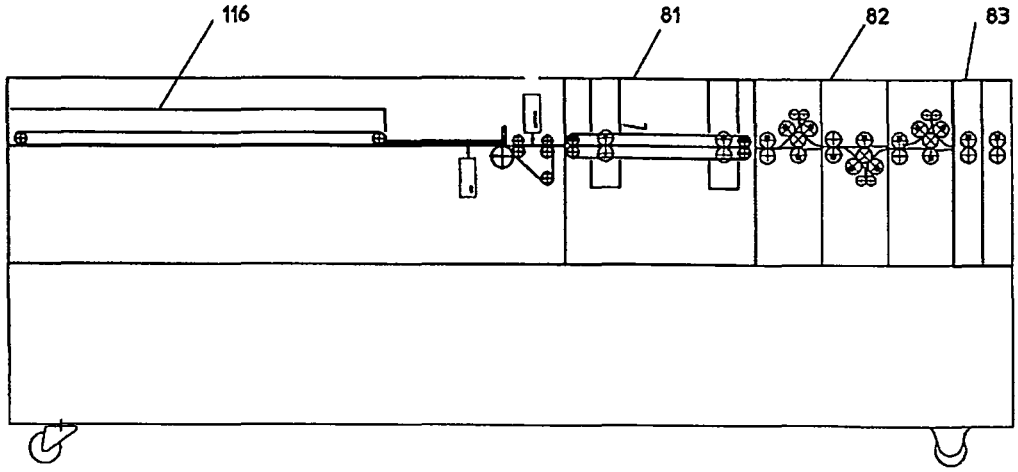
FIG. 55 and FIG. 56 in illustrations corresponding to FIGS. 53 and 54 a further embodiment of a machine with devices according to the invention.
Figure 56:
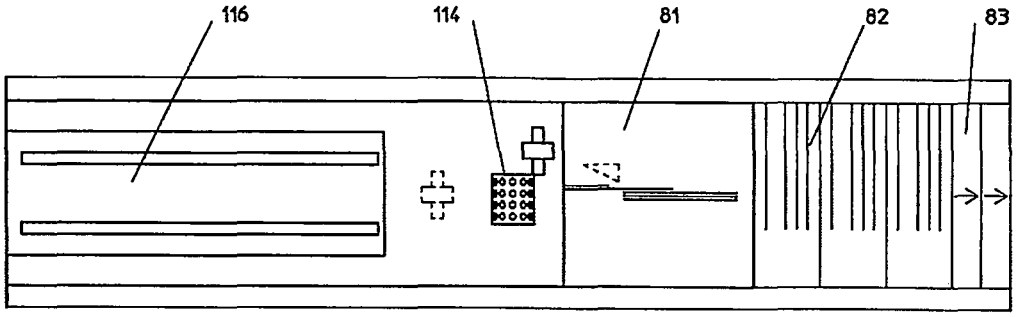

In the embodiment according to FIGS. 55 and 56 the individual sheets are inserted into the machine and are subsequently processed. As in the preceding embodiment, the sheets are transported on a straight path through the machine. The device has a loading module 116 into which the individual sheets are inserted. By means of the transport element 114 the sheets are supplied to the accumulator module 81 in which the products to be processed are combined to sets. Downstream of the accumulator module 81 there is the folding module 82 that is comprised, for example, of three folding devices. In an exemplary fashion, they are of the same configuration as the folding devices according to FIGS. 53 and 54. The folding module 82 has downstream thereof a buffering module 83 that in accordance with the preceding embodiment is embodied for example with two sequentially arranged buffers. The folding devices in the folding module 82 are adjustable independent from one another so that the sheets, depending on the adjustment, can pass through the machine without being processed or can be provided with different folds.

Figure 57:
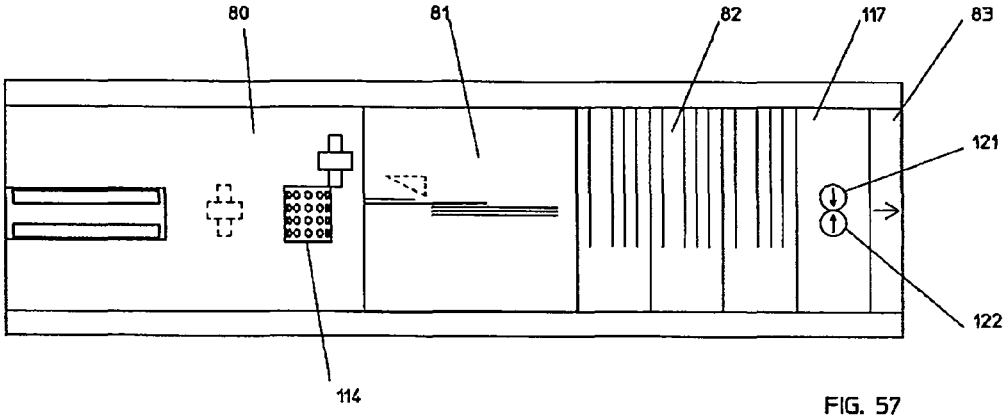
FIG. 57 to FIG. 60 in a plan view and in schematic illustration, respectively, further embodiments of machines with devices according to the invention.

The device according to FIG. 57 has the intake module 80 in which a feeder with at least one transport element 114 re located. In the embodiment it is embodied identical to the transport element according to FIG. 56. With it, the sheets are supplied to the accumulator module 81 in which the sheets in the described way are combined to sets. A folding module 82 is arranged downstream of the accumulator module 81 and comprises, for example, three folding devices. As explained in connection with FIGS. 53 to 56, the folding devices can be adjusted independent from one another so that the sheets can be processed in different ways or are not processed.

A pressing module 117 is arranged downstream of the folding module 82 with which the sheets are pressed in the area of the fold. The pressing module 117 has two pressing rollers 121, 122, that are forced against one another. In this way, the sheet is being pressed in the area of the fold. In this connection, it is even possible to move the sheet back and forth by appropriate reversal of the rotational direction of the pressing rollers 121,122 in order to exert a satisfactory pressure on the fold edge.

A buffering module 83 adjoins the pressing module 117 with which the processed or unprocessed sheets are guided away or supplied to another processing module of the machine.

Figure 58:
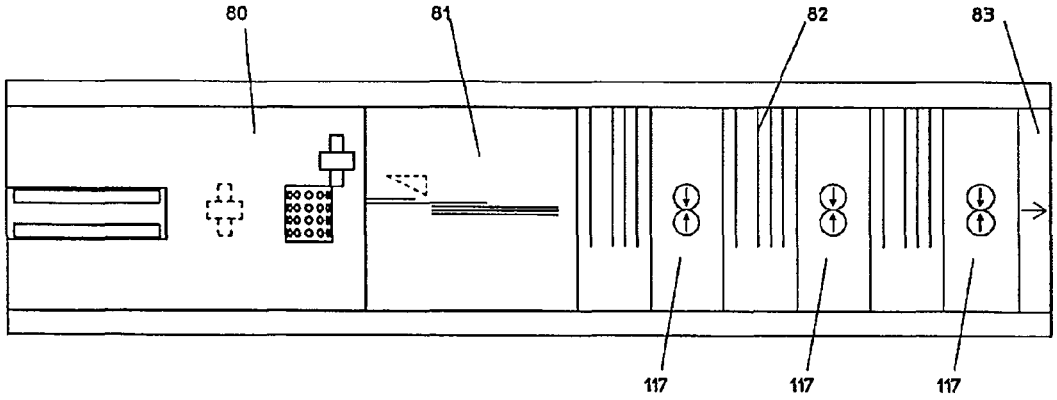

The machine according to FIG. 58 has the intake module 80 and the accumulator module 81 arranged downstream; they are of identical design as in the embodiment of FIG. 57. The folding module 82 downstream of the accumulator module 81 has three folding devices which, however, in contrast to the embodiment according to FIGS. 53 to 57 are not arranged immediately behind one another but with intermediate positioning of a pressing module 117, respectively. In this way, the fold provided in the folding device is immediately thereafter processed by means of the pressing module 117 before the sheet is supplied to the next folding device. Between the last folding device and the subsequent buffering module 83 a further pressing module 117 is arranged.

Figure 59:
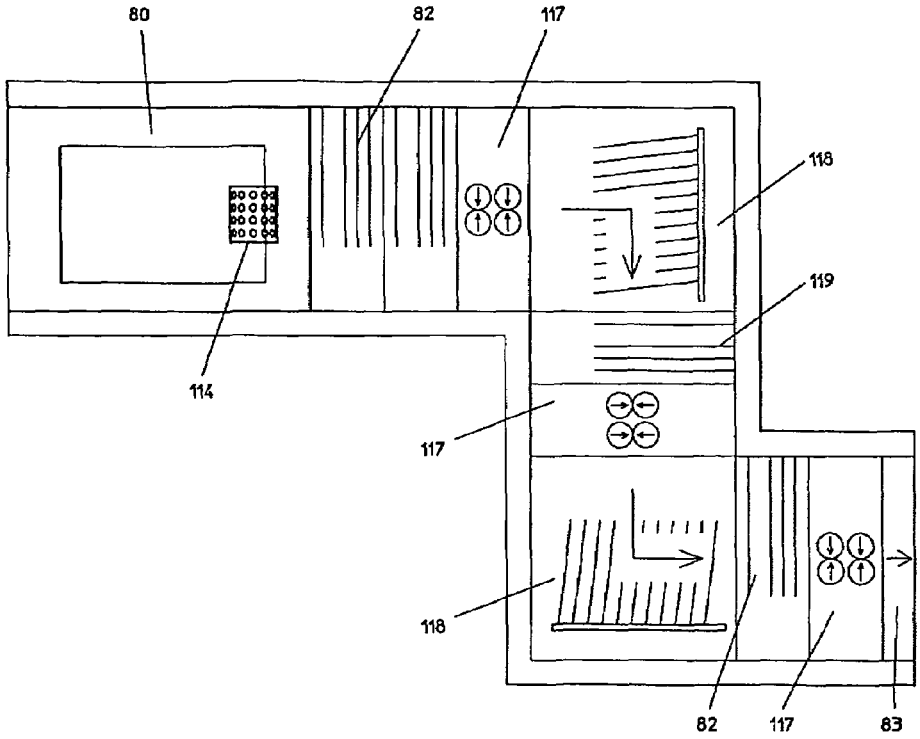

Since the machines according to FIGS. 53 to 58 are designed such that the sheets are transported on a straight path through the machine, FIG. 59 shows in an exemplary fashion a machine in which the transport direction of the sheets through the machine has two deflections. This machine comprises the intake module 80 with transport element 114 with which the sheets are supplied to the downstream folding module 82. It has two folding devices and an adjoining pressing module 117. The two pressing devices are adjustable independent from one another so that with them the sheets can be processed depending on the processing task. Depending on the adjustment of the respective folding device it is also possible that the sheets pass without being folded through the folding device. By means of the pressing module 117 the folds are processed. In the illustrated embodiment the pressing module has two pressing roller pairs with which the folds can be processed as the folded sheets pass between the pressing rollers. A corner conveying module 118 adjoins the pressing module 117 with which the transport direction of the sheets is changed by 90 degrees. After the 90 degree deflection the sheets reach a folding device 119 that has arranged downstream thereof a pressing module 117. A further corner conveying module 118 adjoins the pressing module 117 with which the transport direction of the sheets is again deflected by 90 degrees. Downstream of the corner conveying module 116 there is a folding module 82 and a buffering module 83. The folding module 82 has a folding device as well as a pressing module 117.

Figure 60:
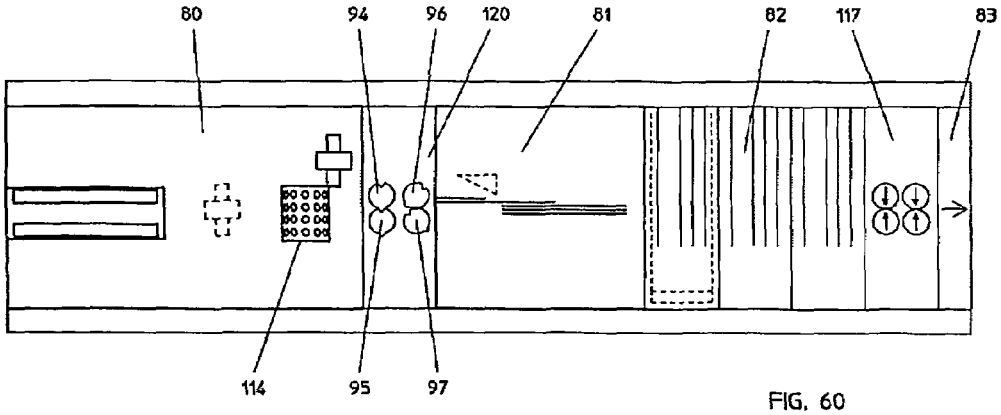

FIG. 60 finally shows a machine in which the sheets are transported again without deflection through the device. The sheets are transported by means of the intake module 80 with the transport element 114 to the embossment module 120 that comprises embossment roller pairs 94 to 97 as disclosed in connection with FIG. 42. Downstream of the embossment module 120 there is the accumulator module 81 with which the sheets in the described way are combined to sets.

The folding module 82 adjoins the accumulator module 81 that in accordance with the machines of FIGS. 53 to 56 has three sequentially arranged roller devices. In this connection, the folding device that adjoins the accumulator module 81 is provided with a diverting compartment. Downstream of the folding module 82 there is a pressing module 117 that has two pressing roller pairs. A buffering module 83 adjoins the pressing module 117 with which the sheets are diverted or supplied to a further module.

The examples of machines disclosed in connection with FIGS. 53 to 60 show that based on the different modules each machine can be optimally combined in accordance with the wishes of the client in order to process the sheets with the modules. With the described folding devices with adjustable rollers and/or sheet guiding elements, different manipulations on the sheets can be carried out in the described way. The folding devices can be controlled flexibly so that each leaf or each sheet B can be folded in different ways. In this way it is achieved that for the same or variable initial sizes of the sheets signatures with different folding types can be folded to one or several defined final formats. It is possible without problem to adjust the folding rollers and/or the different guiding elements for each sheet so that sequentially supplied sheets can be folded in a variety of different ways. The adjustment of the folding rollers and of the guiding elements is possible within a very short period of time. Accordingly, the sheets can be processed individually. It is conceivable easily that each sheet or only the first sheet and/or the last sheet of each set of sheets can be provided with a barcode, for example, that is detected by a reading device that, according to the information contained in the barcode, will adjust the machine or the folding device in order to perform on the sheet the required processing steps. The sheets B can be supplied by a flat stacking feeder, a vacuum feeder, a cutting unit or a printer into the machine. In the latter case, the sheet is printed in the printer and subsequently immediately supplied to the folding device for processing.

The information in regard to preparing or processing each product (individual sheet or combined set) accompanies this product through the entire machine and can generate on the fly at any station of the machine appropriate adjustments or switching actions. This information can advantageously be provided in the form of a barcode on the product. The individual stations of the machine are provided with corresponding reading units that read the barcodes and accordingly adjust the stations. As has been described in an exemplary fashion, all kinds of folds can be produced. The folding lengths can vary. Depending on the position of the folding rollers and/or the guiding elements switching between folding and not folding can be realized. The sheets or sets of sheets can be controlled. In the machine individual sheets or even sets comprised of at least two sheets can be turned without problem. All these functions can vary from product to product because the information in regard to preparing and processing is present on each product and can be read from the product at any time upon passage through the machine.

What is claimed is:

1. A device for folding flat articles such as sheets of paper, plastic, cardboard and the like, the device comprising:

conveying elements embodied as rollers that are arranged axis-parallel to each other, are rotatably driven, and form a part of a conveying unit, wherein the conveying unit comprises at least a first pair and a second pair of the rollers;

wherein the flat articles during transport through the device in a transport direction are conveyed between the nip between neighboring oppositely rotating rollers, respectively;

wherein the conveying unit is configured to pivot about a pivot axis and by pivoting the conveying unit about the pivot axis at least some of the rollers are adjustable between at least two positions for performing different folding actions on the flat article;

wherein, for producing a fold on a flat article, the first pair of the rollers that produce the fold are stopped when the flat article is located in a nip of the first pair of the rollers and a rotational direction of the first pair of the rollers is then reversed while the second pair of the rollers upstream of the first pair of the rollers continue to transport the flat article in the transport direction.

2. The device according to claim 1, comprising sensors that detect movements of the article.

3. The device according to claim 1, wherein the device is controlled on the fly.

4. The device according to claim 1, wherein the device is configured as a module.

5. The device according to claim 4, wherein several of said modules are combined to a machine.

6. The device according to claim 5, wherein said several modules are controlled on the fly.

* * * * *